United States Patent [19]

Meyers

[11] 4,276,443

[45] Jun. 30, 1981

[54] SOUND REPRODUCING SYSTEM UTILIZING MOTIONAL FEEDBACK AND VELOCITY-FREQUENCY EQUALIZATION

[76] Inventor: Stanley T. Meyers, 122 N. Riverside St., Red Bank, N.J. 07701

[21] Appl. No.: 67,515

[22] Filed: Aug. 17, 1979

[51] Int. Cl.[3] ..... H04R 3/04

[52] U.S. Cl. ..... 179/1 F

[58] Field of Search ..... 179/1 D, 1 F, 1 P, 1 A, 179/1 FS, 115.5 R, 115.5 DV, 115.5 VC; 330/109, 110; 333/28 T; 181/31 B

[56] References Cited

U.S. PATENT DOCUMENTS

| | | | |
|---|---|---|---|
| 3,798,374 | 3/1974 | Meyers | 179/1 F |
| 3,821,473 | 6/1974 | Mullins | 179/1 F |
| 3,878,748 | 4/1975 | Spence | 179/1 F |
| 4,025,722 | 5/1977 | Karron | 179/1 F |

OTHER PUBLICATIONS

"The Philips Motional Feedback System", undated trade circular distributed by North American Philips Corp.

*Primary Examiner*—Thomas A. Robinson
*Attorney, Agent, or Firm*—R. Martin Oliveras

[57] ABSTRACT

A sound reproducing system utilizes motional feedback and velocity-frequency equalization to reduce loud speaker distortion. The system substantially comprises a frequency equalizer-power amplifier combination which is jointly responsive to the input source signal and to a velocity feedback equalizer; the loud speaker structure which is responsive to the frequency equalizer-power amplifier combination; a cone motion sensing structure which is responsive to the motion of the loud speaker cone; an auxiliary amplifier which is responsive to the cone motion sensing structure; and the velocity feedback equalizer which is responsive to the auxiliary amplifier. Features of the present invention are that: the velocity shaped signal from the velocity feedback equalizer is degeneratively applied to the frequency equalizer-power amplifier combination which, in turn, forces the loud speaker to respond linearly to the input source signal and thereby provide a uniform sound energy output; the velocity-frequency equalization effect is limited to that frequency range over which the loud speaker cone operates substantially as a rigid member; the velocity feedback equalizer loss characteristic exhibits a positive slope over the low frequency and rigid member operating frequency range of the cone, and a zero slope over the high frequency range of the cone; the frequency equalizer loss characteristic exhibits a zero slope over the low frequency range of the cone, a positive slope over the rigid member operating frequency range of the cone, and a zero slope over the high frequency range of the cone; and the power amplifier gain characteristic exhibits a zero slope over the low frequency range of the cone, a negative slope over the rigid member operating frequency range of the cone, and a zero slope over the high frequency range of the cone. An advantage of the present invention is that it allows use of relatively small loud speakers and loud speaker enclosures.

14 Claims, 3 Drawing Figures

SOUND REPRODUCING SYSTEM UTILIZING MOTIONAL FEEDBACK AND VELOCITY-FREQUENCY EQUALIZATION

CROSS-REFERENCE TO RELATED APPLICATION

This application is related to copending application Ser. No. 067,516, entitled "*Sound Reproducing System Utilizing Motional Feedback and Integrated Magnetic Structure*", filed simultaneously herewith.

FIELD OF THE INVENTION

This invention relates to sound reproducing systems, and, in particular, to such systems which include the loud speaker in a feedback path.

BACKGROUND OF THE INVENTION

Several prior art sound reproducing systems have included the loud speaker in a feedback path for reducing loud speaker distortion, for providing a linear loud speaker response, for providing a uniform loud speaker sound energy output, and for allowing the use of small loud speakers and loud speaker enclosures. Such prior art systems, especially those which include means for magnetically sensing the axial motion of the associated loud speaker cone, have considered neither the detrimental effects due to electrical interference from the main electromagnetic loud speaker structure, nor the proper frequency shaping of the motional signal to cause the loud speaker to respond linearly to the input source signal. Further, none of these prior art motional feedback systems have effectively compensated for inherent amplifier gain limitations.

Such prior art sound reproducing systems are cited in U.S. Patent No. 3,798,374 entitled, "Sound Reproducing System Utilizing Motional Feedback", issued on Mar. 19, 1974 to Stanley Thayer Meyers, Applicant herein.

Further, U.S. Pat. No. 3,821,473 entitled, "*Sound Reproduction With Driven And Undriven Speakers And Motional Feedback*", issued on June 28, 1974 to Mullins discloses amplifier 4, device 12, and speakers 14 and 16. In such system, there is included an undriven speaker and each of the speakers mounted in the enclosure have different resonant frequencies and motional feedback devices attached thereto. The outputs of the motional feedback devices are combined to produce a negative feedback signal to the amplifier. Such system also includes motional sensor 18. Such sound reproduction system relates to combined motional feedback control of driving and driven speakers in a single enclosure. There does not appear to be a description of any particular type of motional sensing means, even though acceleration sensing is mentioned.

U.S. Patent No. 3,878,748 entitled, "*Oral Cavity Controlled Electronic Musical Instrument*", issued on Apr. 22, 1975 to Spence discloses sensor coil 58. FIG. 9 of such patent refers to a method of divesting a separate sensing coil of interference from the voice coil. Such arrangement appears to be a ramification of bridge type feedback control.

U.S. Patent No. 4,025,722 entitled, "Method And Apparatus For Recording", issued on May 24, 1977 to Karron discloses speaker 20 including voice coil 18 and auxiliary winding 30. The output of auxiliary winding 30 is coupled to primary winding 32 of transformer 34, but does not appear to be fed back to amplifiers 16 thereof.

The North American Philips Corporation distributes a sound reproducing system including a signal source, an electronic crossover, a comparator, a low frequency amplifier, a woofer, a piezoelectric sensor, a high frequency amplifier, a second crossover, a mid-range speaker, and a tweeter speaker. In such sound reproducing system, acceleration feedback is utilized, but only in the so-called woofer speaker.

However, none of the aforementioned prior art sound reproducing systems incorporate combined velocity-frequency equalization to produce a motional feedback signal according to the present invention.

Objects of the present invention are therefore to:

Utilize motional feedback in a sound reproducing system for reducing loud speaker distortion, for effecting linear loud speaker response, and for providing a uniform sound energy output;

Utilize motional feedback in a sound reproducing system wherein relatively small loud speakers and loud speaker enclosures are required; and Apply combined velocity-frequency equalization to the motional feedback signal to effect the above mentioned objects.

SUMMARY OF THE INVENTION

According to the present invention, a sound reproducing system utilizing motional feedback and velocity-frequency equalization provides a substantially uniform sound energy output, results in linear loud speaker response, and reduces loud speaker distortion. Such system generally comprises a frequency equalizer-power amplifier combination which is jointly responsive to the input source signal and to a velocity feedback equalizer; the loud speaker structure which is responsive to the frequency equalizer-power amplifier combination; a cone motion sensing structure which is responsive to the motion of the loud speaker cone; an auxiliary amplifier which is responsive to the cone motion sensing structure; and the velocity feedback equalizer which is responsive to the auxiliary amplifier.

Features of the present invention are therefore that:

The velocity shaped signal from the velocity feedback equalizer is degeneratively applied to the frequency equalizer-power amplifier combination, which, in turn, forces the loud speaker to respond linearly to the input source signal and thereby reduce loud speaker distortion and provide a uniform sound energy output;

The velocity-frequency equalization effect is limited to that frequency range over which the loud speaker cone operates substantially as a rigid member;

The velocity feedback equalizer loss characteristic exhibits a positive slope over the low frequency and rigid member operating frequency range of the cone, and a zero slope over the high frequency range of the cone;

The frequency equalizer loss characteristic exhibits a zero slope over the low frequency range of the cone, a positive slope over the rigid member operating frequency range of the cone, and a zero slope over the high frequency range of the cone;

The power amplifier gain characteristic exhibits a zero slope over the low frequency range of the cone, a negative slope over the rigid member operating frequency range of the cone, and a zero slope over the high frequency range of the cone; and The loud speaker cone exhibits a velocity vs. frequency characteristic which is substantially approximated by a first straight line having a −6 dB/octave slope, and by a second straight line having a 0 dB/octave slope, these lines intersecting where 0.476 R F is approximately equal to 1.5, R being the loud speaker cone radius in inches and F being the frequency of the loud speaker in kilohertz.

Advantages of the present invention are therefore that:

Relatively small loud speakers and loud speaker enclosures can be used; and

Loud speaker cone performance is substantially independent of enclosure characteristics.

DESCRIPTION OF THE DRAWING

The above and other objects, features, and advantages of the present invention will be better appreciated by consideration of the following detailed description of the drawing in which.

DETAILED DESCRIPTION

Figure 1:
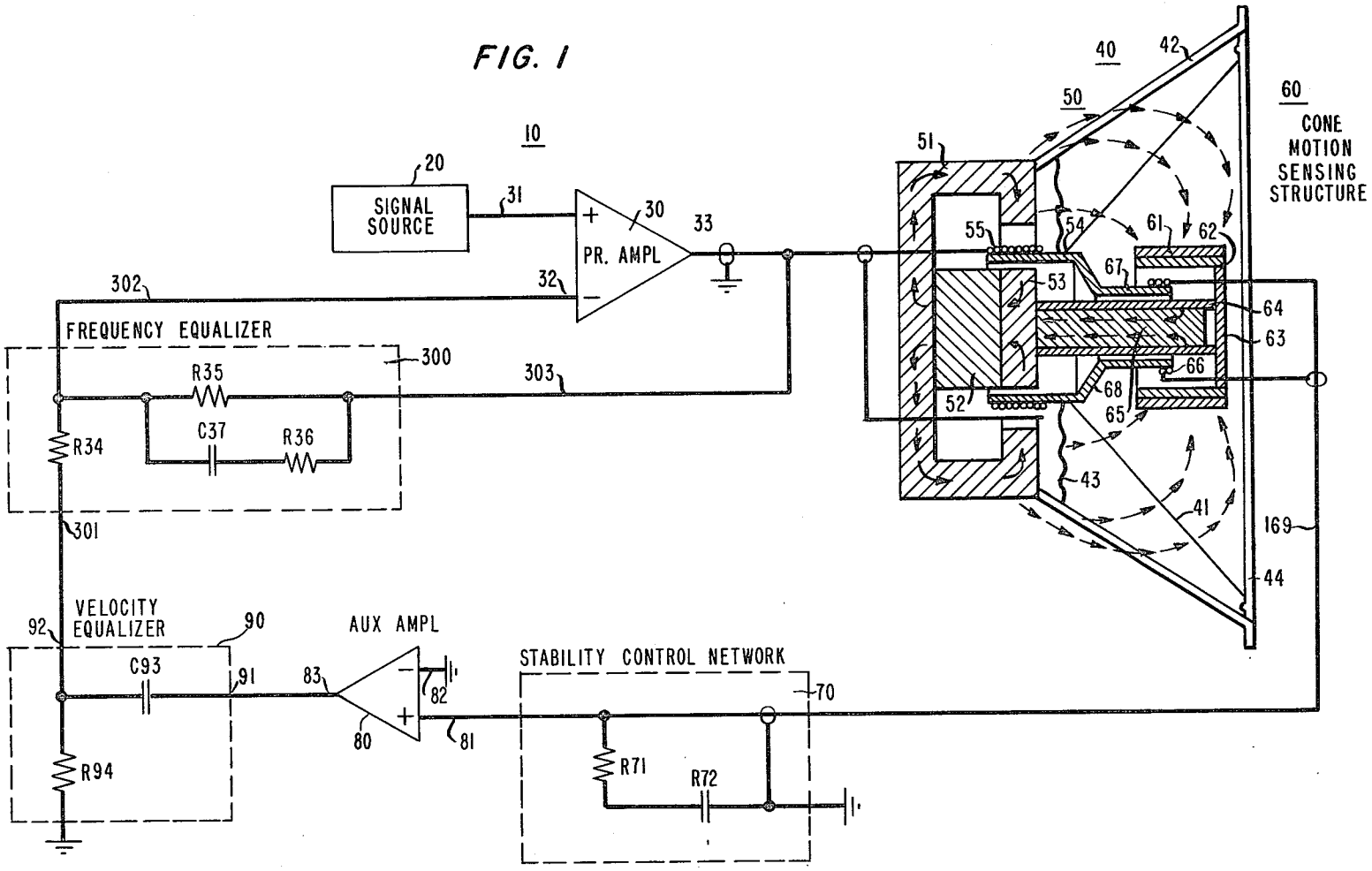
FIG. 1 illustrates a sound reproducing system utilizing motional feedback and velocity-frequency equalization according to the present invention.

FIG. 1 illustrates sound reproducing system 10 utilizing motional feedback and velocity-frequency equalization generally comprising frequency equalizer-power amplifier combination 300-30 which is jointly responsive to input signal source 20 and to velocity feedback equalizer 90; moving-coil type loud speaker structure 40; auxiliary amplifier 80 which is responsive to stability control network 70; and aforementioned velocity feedback equalizer 90 which is responsive to auxiliary amplifier 80. Frequency equalizer 300 is associated with power amplifier 30 as shall be hereinafter explained in detail. The operation of main electromagnetic structure 50 of loud speaker 40 is well known in the art and shall not be included herein. Cone motion sensing structure 60 of loud speaker 40 and stability control network 70 are disclosed and claimed in said copending application Ser. No. 067,516.

Generally, input signal source 20 such as a tuner, turntable, etc., is connected to non-inverting input terminal 31 of differential or operational power amplifier 30. The signal at input terminal 31 is amplified to a high level signal for suitably driving voice coil 55 of direct radiating loud speaker 40. The resultant axial motion of voice coil 55 and its associated bobbin 54 is transmitted to loud speaker cone or diaphragm 41. Portions of cone motion sensing structure 60 are attached to voice coil bobbin 54. In cone motion sensing structure 60, a voltage along conduction path 169 is generated which is functionally related to the motion imparted to feedback coil 66 via feedback bobbin 67. The voltage along conduction path 169 passes through a suitable connection via stability control network 70 and then to non-inverting input terminal 81 of auxiliary or booster amplifier 80 to raise the level of the motional feedback signal enough to drive velocity feedback equalizer 90 at its input terminal 91 and to provide a resultant feedback signal at output terminal 92 of velocity feedback equalizer 90. Thereafter, the motional feedback signal at output terminal 92 of velocity feedback equalizer 90 is applied to input terminal 301 of frequency equalizer 300 associated with power amplifier 30. The signal appearing at output terminal 302 of frequency equalizer 300 is degeneratively applied to negative input terminal 32 of power amplifier 30 while output terminal 303 is connected to output terminal 33.

The function of auxiliary amplifier 80 is to linearly amplify the motional feedback signal which is normally a low voltage signal and to compensate for the later attenuating effect of velocity feedback equalizer 90. This, of course, assures the application of reasonable motional feedback signal levels to power amplifier 30 and associated frequency equalizer 300. In addition, the use of auxiliary amplifier 80 allows for finer and fewer turns in feedback coil 66.

Velocity feedback equalizer 90 further comprises capacitor C93 and resistor R94. The first terminal of C93 is connected to input terminal 91, while the second terminal is connected to output terminal 92. The first terminal of R94 is connected to output terminal 92, while the second terminal is connected to ground. Typical values of C93 may be 0.15 microfarads and of R94 may be 470 ohms.

Frequency equalizer 300 further comprises resistor R34, resistor R35, resistor R36, and capacitor C37. The first terminal of R34 is connected to input terminal 301 while the second terminal is connected to output terminal 302, to the first terminal of R35, and to the first terminal of C37. The second terminal of R35 is connected to output terminal 303 and to the second terminal of R36. The second terminal of C37 is connected to the first terminal of R36. Typical values of R34 may be 4.7 thousand ohms, of R35 may be 1 million ohms, of R36 may be 100 thousand ohms, and of C37 may be 0.001 microfarads.

Figure 2:
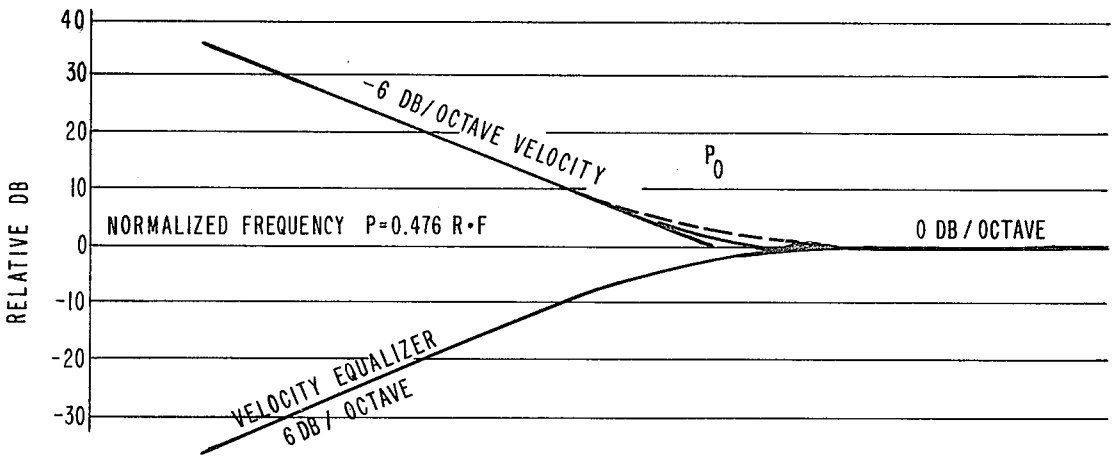
FIG. 2 illustrates the velocity feedback equalizer loss characteristic and cone velocity characteristic according to the present invention.

FIG. 2 on the lower half portion thereof illustrates the loss characteristic of velocity feedback equalizer 90 according to the present invention. The abscissa is normalized frequency P=0.476 RF, where R is the loud speaker cone radius in inches and F is the frequency of the loud speaker cone in kilohertz. The negative ordinate is loss in dB. Po is the intercept between the −6 dB/octave slope and the 0 dB/octave slope of the cone velocity characteristic according to the present invention as shall be hereinafter explained. P1 shall be defined in relation to FIG. 3. The constant parameter Po was discussed in detail in said prior Meyers U.S. Pat. No. 3,798,374. From FIG. 2, it is apparent that such velocity equalizer loss characteristic substantially exhibits +6 dB/octave slope below P=Po and a 0 dB/octave slope above P=Po. Such loss characteristic is approximated by two straight lines of corresponding slopes intersecting at P=Po.

Figure 3:
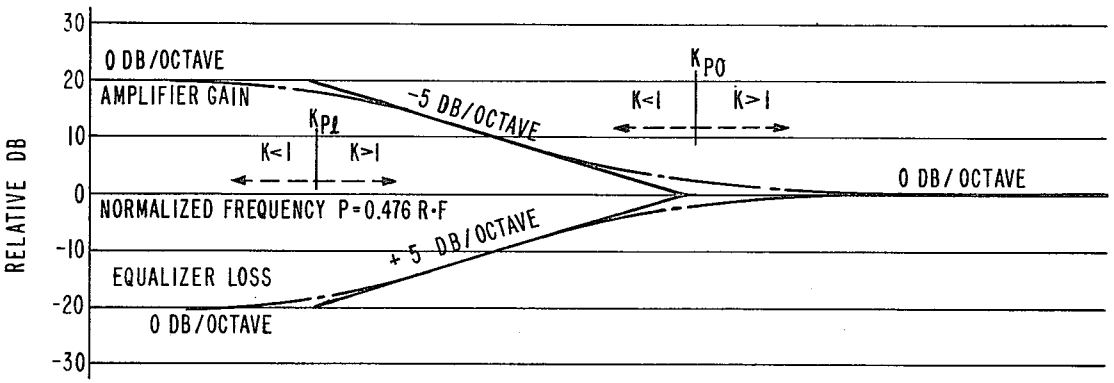
FIG. 3 illustrates the frequency equalizer loss characteristic and the power amplifier gain characteristic according to the present invention.

FIG. 3 on the upper half portion thereof illustrates the differential gain characteristic of power amplifier 30 according to the present invention. The positive ordinate is differential gain in dB of the low frequency range relative to the high frequency range. Such power amplifier gain characteristic substantially exhibits a 0 dB/octave slope below P=KPl, a −5 dB/octave slope above P=KPl and below P=KPo, and a 0 dB/octave slope above P=KPo. Such gain characteristic is approximated by three straight lines of corresponding slopes intersecting at P=KPl and P=KPo. The rigid member upper operating frequency of the loudspeaker cone is defined to be P=KPo, where K is a given constant for a given speaker. The −5 dB/octave slope is advantageously chosen to maximize desirable velocity feedback and to minimize undesirable phase shift. A given amplifier may have a maximum possible differential gain such as 20 dB as shown on the upper half portion of FIG. 3. Accordingly, given P=KPo for a given speaker, given the −5 dB/octave slope assigned to the amplifier, and given the 20 dB differential gain of the amplifier, there results or is defined P=KPl. The parameter KPo may be greater than Po, less than Po, or equal to Po. FIG. 3 on the lower half portion thereof illustrates the loss characteristic of frequency equalizer 300 according to the present invention. Again, the abscissa is normalized frequency P and the negative ordinate is loss in dB. It is apparent that such frequency equalizer loss characteristic substantially exhibits 0 dB/octave slope below P=KPl, a +5 dB/octave slope above P=KPl and below P=KPo, and a 0 dB/octave slope above P=KPo. Such loss characteristic is approximated by three straight lines of corresponding slopes intersecting at P=KPl, and P=KPo. The frequency equalizer loss characteristic and the amplifier differential gain characteristic are substantially mirror images of each other.

Finally, FIG. 2 on the upper half portion thereof illustrates the cone velocity characteristic according to the present invention. The positive ordinate is relative velocity in dB. It is apparent that such cone velocity characteristic is substantially the image of the velocity feedback equalizer loss characteristic. Accordingly, such cone velocity characteristic substantially exhibits a −6 dB/octave slope below P=Po, and a 0 dB/octave slope above P=Po. Such cone velocity characteristic is approximately by two straight lines of corresponding slopes intersecting at P=Po.

The following should be noted:

(A) Cone motion sensing structure 60 of loud speaker 40 may be of the type depicted in FIG. 1 herein; in FIG. 1 of said prior Meyers patent 3,798,374; or any suitable cone motion sensing means which provides a motional feedback signal functionally related to the motion of cone 41 or of the subject sound energy producing means.

(B) Power amplifier 30 is frequency equalized by frequency equalizer 300 so that velocity feedback from velocity feedback equalizer 90 is limited to the frequency range below P=KPo, over which cone 41 of loud speaker 40 operates substantially as a rigid member to effect high amplifier differential gain at relatively low frequencies and low amplifier differential gain at relatively high frequencies. This is done since otherwise the motional feedback signal would tend to exaggerate nonuniform cone motion and thus cause undesired enhancement of such effect in the acoustic output.

(C) Velocity feedback equalizer 90 herein is substantially similar in operation to equalizer 70 of said prior Meyers patent 3,798,374.

(D) From a control viewpoint, it is advantageous to limit the forced operation of cone 41 to the region of constant acceleration below P=Po=1.5 and to the region of constant velocity above P=Po=1.5.

(E) The ideal velocity and frequency equalizer characteristic curves of FIGS. 2 and 3 may be better approximated by using more elaborate circuitry than that used in velocity equalizer 90 and frequency equalizer 300 of FIG. 1. However, those skilled in the art will appreciate that the degree to which one approximates such ideal characteristics is a matter of economics.

(F) It will also be apparent to those skilled in the art that placing the velocity feedback equalizer, the frequency equalizer, the power amplifier, and the cone velocity characteristics on the same normalized frequency scale P allows for relating circuit constants with loud speaker characteristics.

(G) It will be apparent to those skilled in the art that configurations as shown in FIGS. 7A, 7B, and 7C of said prior Meyers patent can be had using sound reproducing system 10 herein. Also, it will be apparent that smaller loud speakers and smaller loud speaker enclosures can be used based on the above.

While the arrangement according to the present invention of a sound reproducing system utilizing motional feedback and velocity-frequency equalization has been described in terms of specific embodiments, it will be apparent to those skilled in the art that many modifications are possible within the spirit and scope of the disclosed principle.

What is claimed is:

1. A sound reproducing system comprising:

first amplifying means being jointly responsive to an input source signal and to a second equalizer output signal;

sound energy producing means being responsive to said first amplifying means;

means for sensing the sound energy output of said sound energy producing means thereby providing a motional feedback signal;

second amplifying means being responsive to said motional feedback signal for producing a second amplifying means output signal;

first equalizer means being responsive to said second amplifying means output signal for producing a first equalizer means output signal, said first equalizer means loss characteristic exhibiting a positive slope in the range between relatively low frequencies and relatively high frequencies;

second equalizer means being associated with said first amplifying means and being responsive to said first equalizer means output signal for producing said second equalizer output signal, said second equalizer means loss characteristic exhibiting a constant value at said relatively low frequencies, a positive slope in the range between said relatively low frequencies and said relatively high frequencies, and a zero value at said relatively high frequencies;

whereby said sound energy producing means radiates a substantially uniform sound energy output in the range between said relatively low frequencies and said relatively high frequencies.

2. The sound reproducing system of claim 1 wherein said sound energy producing means is a loud speaker including a cone and a voice coil, said voice coil being responsive to said first amplifying means for driving said cone; and said sound energy/output sensing means being responsive to the motion imparted to said cone by said voice coil for providing said motional feedback signal.

3. The sound reproducing system of claim 2 wherein said cone exhibits a substantially constant acceleration at said relatively low frequencies and a substantially constant velocity at said relatively high frequencies.

4. The sound reproducing system of claim 2 wherein said cone exhibits a relative velocity vs. frequency response characteristic which is substantially approximated by a first straight line having a slope of −6 dB/octave and by a second straight line having a slope of 0 dB/octave, said straight lines intersecting where 0.476 RF is approximately equal to 1.5, R being the radius of said cone and F being the operating frequency thereof.

5. The sound reproducing system of claim 3 wherein said cone exhibits a substantially constant acceleration at said relatively low frequencies and a substantially constant velocity at said relatively high frequencies, said frequency regions meeting where 0.476 RF is approximately equal to 1.5, R being the radius of said cone and F being the operating frequency thereof.

6. The sound reproducing system of claim 1 wherein said first amplifying means is a differential amplifier further comprising a positive input terminal and a negative terminal, said input source signal being applied to said positive input terminal and said second equalizer output signal being applied to said negative input terminal.

7. The sound reproducing system of claim 1 wherein said second amplifying means is a differential amplifier further comprising a positive input terminal and a negative input terminal, said motional feedback signal being applied to said positive input terminal and said negative input terminal being grounded.

8. The sound reproducing system of claim 2 wherein said first equalizer means exhibits a loss versus frequency characteristic which is substantially approximated by a first straight line having a positive slope and by a second straight line having a zero slope, said straight lines intersecting where 0.476 RF is approximately equal to 1.5, R being the radius of said cone and F being the operating frequency thereof.

9. The sound reproducing system of claim 8 wherein said first straight line has a slope of +6 dB/octave.

10. The sound reproducing system of claim 2 wherein said second equalizer means exhibits a loss versus frequency characteristic which is substantially approximated by a first straight line having a zero slope at said relatively low frequencies, a second straight line having a positive slope in the range between said relatively low frequencies and said relatively high frequencies, and a third straight line having a zero slope, said second and third straight lines intersecting where 0.476 RFK is approximately equal to 1.5 K, R being the radius of said cone in inches, F being the operating frequency thereof, and K being a constant.

11. The sound reproducing system of claim 10 wherein said second straight line has a slope of +5 dB/octave.

12. The sound reproducing system of claim 2 wherein said cone operates substantially as a rigid member in the range between said relatively low frequencies and said relatively high frequencies.

13. The sound reproducing system of claim 2 wherein said first amplifying means exhibits a differential gain versus frequency characteristic which is substantially approximated by a first straight line having a zero slope at said relatively low frequencies, a second straight line having a negative slope in the range between said relatively low frequencies and said relatively high frequencies, and a third straight line having a zero slope, said second and third straight lines intersecting where 0.476 RFK is approximately equal to 1.5 K, R being the radius of said cone in inches, F being the operating frequency thereof, and K being a constant.

14. The sound reproducing system of claim 13 wherein said second straight line has a slope of −5 dB/octave.

* * * * *